United States Patent [19]

Behrens

[11] Patent Number: 4,617,200

[45] Date of Patent: Oct. 14, 1986

[54] PROCESS FOR MAKING SALT COATED MAGNESIUM GRANULES

[75] Inventor: Hugh C. Behrens, Angleton, Tex.

[73] Assignee: The Dow Chemical Company, Midland, Mich.

[21] Appl. No.: 741,783

[22] Filed: Jun. 6, 1985

[51] Int. Cl.[4] ..... C22C 1/04; B22F 9/08

[52] U.S. Cl. ..... 427/216; 75/0.5 B; 264/7

[58] Field of Search ..... 75/0.5 B; 264/7; 427/216

[56] References Cited

U.S. PATENT DOCUMENTS 4,384,887 5/1983 Skach et al. ..... 75/0.5 B 4,410,356 10/1983 Skach ..... 75/0.5 B 4,421,551 12/1983 Mueller ..... 75/0.5 B 4,457,775 7/1984 Legge et al. ..... 75/0.5 B 4,500,349 2/1985 Skach ..... 75/0.5 B

*Primary Examiner*—Michael R. Lusignan

*Attorney, Agent, or Firm*—Glwynn R. Baker

[57] ABSTRACT

There is disclosed a process for the preparation of substantially uniform granules of magnesium coated with a mixed salt composition from a eutectic melt. The process comprises the steps of forming globules of magnesium by shear action in a molten eutectic mixed salt bath which is maintained molten at a temperature of at last ten degrees Centrigrade below the freezing temperature of the magnesium.

3 Claims, 2 Drawing Figures

PROCESS FOR MAKING SALT COATED MAGNESIUM GRANULES

BACKGROUND OF THE INVENTION

Existing processes for the preparation of magnesium granules which are coated with a salt composition and used in the steel industry are exemplified by U.S. Pat. Nos. 4,186,000; 4,279,640; 4,384,887; and, 4,410,356. These processes employ many more steps than the presently contemplated process in that they apparently form discrete globules by stirring the molten magnesium/salt mixture to form discrete particles or globules of magnesium within the salt bath and allow the entire mixture to solidify. The salt coated granules are released from the cake by use of a hammer mill. Such a procedure leaves a thin coating of salt adhered to the magnesium. The salt in excess of that to coat the granule is circulated back to the process or discarded. Thus, the present invention saves considerable power and obtains more uniform granules.

IN THE DRAWING

An idealized system for carrying out the invention is shown in the drawing.

BRIEF DESCRIPTION OF THE INVENTION

In accordance with the present invention there is described a novel process for the production of substantially uniform granules of magnesium coated with a thin layer of a mixed salt composition by forming a molten body of the mixed salts, usually the eutectic mixture of these salts, which mixture has a freezing point at least ten degrees centigrade below the freezing point of the magnesium, and introducing into this bath in a tangential manner at a rate and a velocity to effect a shearing action on the molten metal forming thereby a globule of magnesium as the molten metal is introduced into the bath. A convenient manner of introducing the molten magnesium into the salt bath is to use a wheel having small holes in its periphery and pumping the magnesium into the wheel and out the small holes, while rotating the wheel at a high rate of speed. Such action imparts a shearing action to the magnesium globule as it is forced out of the small hole in the periphery of the wheel into the substantially slow moving bath body. It is of course to be understood that other means for introducing the small magnesium globules into the bath may be employed so long as the size is controlled and the globule has the ability to spherize as it cools in the bath. Other means of forming small magnesium globules in the bath involve typical metal bead and shot forming techniques carried out in a molten chilling bath, such as concentric nozzles, cavity resonators, or pumped flow pulsators. Many variations of these means are known by those skilled in the art. The bath is, as above described, maintained at a temperature of at least ten degrees centigrade below the freezing point of the magnesium, and preferably about twenty to forty degrees below the freezing point of the magnesium. The bath of course must have a freezing point at least several degrees below the temperature at which the bath is maintained so that on removal from the vessel the salt in its molten state can be separated from the magnesium, yet a thin layer can be maintained on the surface of the globule (granule), which will rapidly solidify thereon preventing excessive agglomeration of the granules one to the other. The bath should also have a characteristic density greater than that of the magnesium so that the magnesium globule will rise through the bath as it cools and forms the desired spherical shape. The salt bath is circulated from the globule forming step to a cooling zone by overflowing the globule forming vessel. After cooling, the salt bath free of magnesium globules is pumped back into the globule forming vessel. The globule separating step is performed by passing the overflow from the globule forming vessel, which overflow carries not only the salt but the globules now in a substantially spherical shape, over an inclined screen which will permit the molten salt to drop through but retain the globule thereon. The granule will retain a thin layer of the mixed salts on its surface, albiet not the same composition as the eutectic, and is allowed to cool to the salt freezing temperature with minimal contact of one granule with the other while moving down the inclined screen. The salt flowing through the screen can be conveniently cooled by directing it to a vessel which is poorly insulated and surrounds the globule forming step vessel or the cooling may take place in a separate vessel with supplemental cooling means.

DETAILED DESCRIPTION OF THE INVENTION

Figure 1:
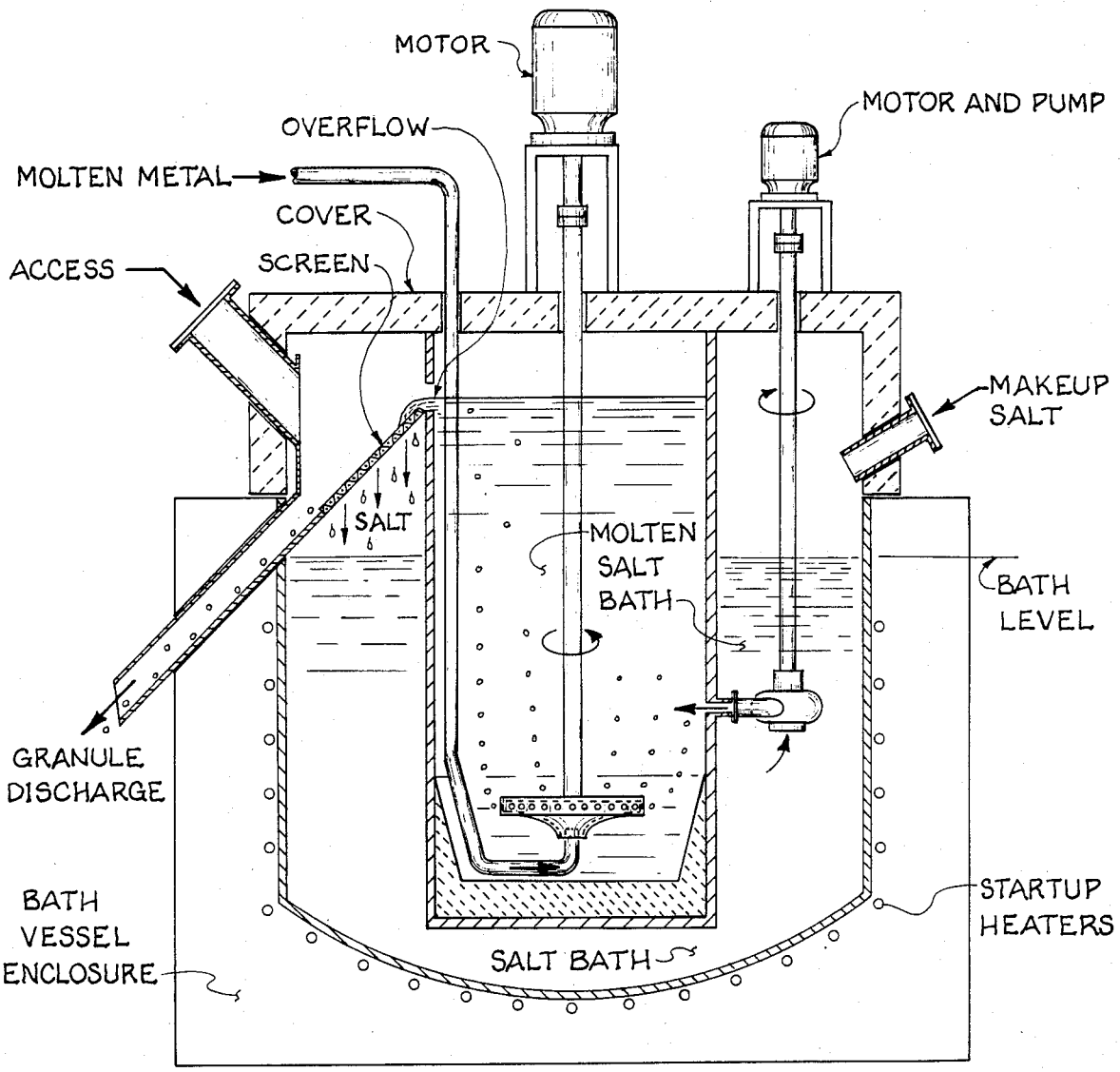
Figure 2:
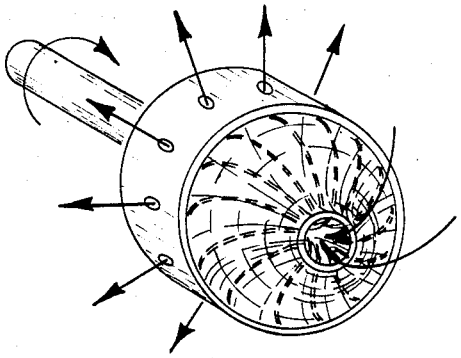

In accordance with the present invention, with particular reference to the drawing of which FIG. 1 shows in cut-away cross section an apparatus suitable for holding a molten salt bath provided with heaters to bring the bath's vessel enclosure interior to operating temperature. A cylindrical well is positioned within the enclosure interior and is provided with a motor driven rotar which may be as shown in FIG. 2, a conventional pump impeller having a band around its periphery which band has holes to enable the liquid being drawn into the impeller to be thrown tangentially outwardly into the molten salt bath. The center or suction side of the impeller is fed from a tube extending to the exterior of the enclosure to a source of molten metal. A centrifugal pump is located in the enclosure ouside the well and is piped to the well to circulate salt bath from the enclosure with the well. The well is provided with an overflow near its top which opens to a screen to retain salt coated magnesium granule but allow the liquid salt to pass through. The screen extends to a discharge chute through the wall of the enclosure. The enclosure is provided with a cover, an access to the screen zone and a salt make up access. Employing such apparatus substantially uniform granules of magnesium coated with a thin layer of a mixed salt composition were formed in a molten body of mixed salts, a eutectic mixture of 33.3 wt. % sodium chloride and 66.7 wt. % calcium chloride which mixture has a freezing point of 500° C., 151° below the freezing point of the magnesium, by introducing the molten magnesium into this bath in a tangential manner from a hollow wheel, a six inch diameter closed vane centrifugal pump impeller which had a thin band secured circumferentially about its vane periphery which band had 100 small holes, orifices of 0.040 inch diameter piercing the band preferably in a spiral pattern on the band. The wheel was rotated at a speed of about 1150 rpm, which with the 3 inch radius of the wheel provided about 30 feet per second shear velocity, as well as the head pressure to force the molten magnesium through the holes, the impeller acting as a pump impeller. The bath was maintained at a temperature of about 620° C. The bath had a density greater than that of the magnesium so that the magnesium globule rose through the bath and formed a spherical shape. The salt bath circulated from the globule forming step to a cooling zone by overflowing the globule forming vessel carrying out with it the rising globule. The globule and its attendant molten salt were sent to a wire mesh screen through which the molten salt would pass but upon which the granules of magnesium would be retained. The salt flowed into a large concentric vessel surrounding the globule forming step vessel and was pumped into the globule forming vessel at a point adjacent to the wheel. The molten salt bath on leaving the globule forming vessel was at a temperature of about 640°–650° C., heat being absorbed from the molten magnesium as it solidifies in the bath. The bath flowing through the screen cooled to about 620°–625° C. while in the concentric vessel due to poor insulation on the vessel, the heat being lost to the ambient atmosphere. Magnesium was fed to the rotating wheel at a rate of about 15–20 pounds per minute. Make-up of salt bath was about 0.75 to 2 pounds of sodium chloride per minute. The reason that the salt make up is essentially only sodium chloride is that on cooling the sodium chloride freezes out of the eutectic first and thus coats the surface of the magnesium and is the principal ingredient removed from the bath.

What is claimed is:

1. A process for the production of substantially uniform granules of magnesium metal coated with a thin layer of a mixed salt composition which comprises:

forming a bath of a molten mixed salt of eutectic nature, which mixture has a freezing point at least 10° below the freezing point of magnesium;

introducing into said bath in a tangential manner a stream of molten magnesium at a rate and velocity to effect a shearing action on the magnesium as it enters the bath forming a globule;

maintaining the bath of a depth and a temperature such that the magnesium will solidify at its surface and rise upwardly through the bath;

withdrawing said bath and its attendant magnesium granules from the bath;

passing the said withdrawn molten salts containing solid magnesium granules over a screen thereby to separate salt coated granules from the molten bath;

returning the molten bath, after cooling, to the first step; and, recovering said magnesium granules with a thin coat of salt thereon.

2. In the process of claim 1 wherein the body of the molten mixed salt bath is the eutectic mixture sodium chloride and calcium chloride, said bath being maintained at about 620°–625° C. by loss of heat from the recycling bath to the ambient atmosphere.

3. In the process of claim 1 wherein the thickness of the salt layer on the granule is controlled by the temperature of the bath exiting the granule forming step.

* * * * *